United States Patent [19]

Alexander et al.

[11] Patent Number: 4,952,747

[45] Date of Patent: Aug. 28, 1990

[54] REMOVAL OF DIAMONDOID COMPOUNDS FROM HYDROCARBONACEOUS FRACTIONS

[75] Inventors: Richard A. Alexander; Charles E. Knight, both of Mobile, Ala.; Darrell D. Whitehurst, Titusville, N.J.

[73] Assignee: Mobil Oil Corp., New York, N.Y.

[21] Appl. No.: 358,759

[22] Filed: May 26, 1989

[51] Int. Cl.[5] ..... C07C 7/10; C07C 7/12

[52] U.S. Cl. ..... 585/803; 208/334; 208/335; 208/337; 208/341; 585/352; 585/825; 585/826; 585/867

[58] Field of Search ..... 585/867, 803, 823, 825, 585/826, 352, 350; 208/337, 334, 335, 341, 361, 311

[56] References Cited

U.S. PATENT DOCUMENTS

| | | | |
|---|---|---|---|
| 2,666,500 | 1/1954 | Cahn et al. | 585/823 |
| 3,094,569 | 6/1963 | Thomas | 585/823 |
| 3,567,791 | 3/1971 | Fuller | 585/857 |
| 4,083,772 | 4/1978 | Asselin et al. | 585/857 |
| 4,793,545 | 1/1909 | Schmidt | 585/823 |

OTHER PUBLICATIONS

K. Tominaga et al., "Next Generation Fine Chamicals Raw Material-Adamantane", Chemical Economy & Engineering Review, vol. 17, No. 10, pp. 23-30, (1985).

R. C. Fort, Jr., The Chemistry of Diamond Molecules, Marcel Dekker, (1976).

"Operating Problems in the Hanlan Swan Hills Gas Field" by W. J. King, Presented at the SPE Gas Technology Symposium, Jun. 13-16, 1988, Dallas, TX.

*Primary Examiner*—Asok Pal

*Attorney, Agent, or Firm*—Alexander J. McKillop; Charles J. Speciale; Robert B. Furr, Jr.

[57] ABSTRACT

According to this invention, substantially hydrocarbonaceous fractions comprising diamondoid compounds are peculiarly suitable for separation by a thermal gradient diffusion process. Applicability of this process to this service is dependent upon the fact that the diamondoid compounds exhibit a large change in viscosity relative to temperature, that is, their viscosity goes down significantly per degree of increase in temperature.

20 Claims, 5 Drawing Sheets

THERMAL DIFFUSION SEPARATION

REMOVAL OF DIAMONDOID COMPOUNDS FROM HYDROCARBONACEOUS FRACTIONS

CROSS REFERENCE TO RELATED APPLICATIONS

The present application is related by the disclosure of similar subject matter to commonly-assigned application Ser. Nos. 358,758, 358,760, and 358,761, filed concurrently herewith.

BACKGROUND OF THE INVENTION

This invention relates to the removal of certain components from hydrocarbon streams. It more particularly refers to separating diamondoid organic compounds from hydrocarbon streams containing such.

Many hydrocarbonaceous mineral streams contain some small proportion of diamondoid compounds. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules*, Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presense of diamondoid compounds in natural gas has been found to cause plugging in the process equipment requiring costly maintenance downtime to remove. On the other hand, these very compounds which can deleteriously affect the profitability of natural gas production are themselves valuable products.

BROAD STATEMENT OF THE INVENTION

In order to recover the diamondoid values in the hydrocarbonaceaous mineral, or in a fraction thereof, this source may be treated directly with a suitable solvent, such as an aromatic distillate fuel oil, in order to partition the diamondoids from their source into the distillate extractant which can be further resolved. Alternatively, if the source fraction has an appropriate composition, it can itself be subjected to resolution to remove the diamondoid compounds directly therefrom. Further, in some instances, the diamondoid compounds will precipitate out in the processing equipment and such equipment needs to be periodically flushed to remove the diamondoid precipitants, or to remove deposited diamondoids before their concentration reaches precipitation levels, thus forming a liquid fraction comprising the flushing medium and the diamondoid compounds dissolved therein. Suitable flushing liquids are exemplified by aromatic distillate fuel oils. These compositions can then be resolved.

According to this invention, substantially hydrocarbonaceous fractions comprising diamondoid compounds are peculiarly suitable for separation by a thermal gradient diffusion process. Applicability of this process to this service is dependent upon the fact that the diamondoid compounds exhibit a large change in viscosity relative to temperature, that is, their viscosity goes down significantly per degree of increase in temperature. In fact, their viscosity rate of change with temperature is substantially greater than that of other hydrocarbons of similar boiling point range.

The invention further includes a method for collecting diamondoid comounds from hydrocarbonaceous gas streams by contacting the gas stream with a liquid solvent in which diamondoid compounds are at least partially soluble. It has been found that the diamondoid compounds are preferentially dissolved from the gas stream into the selected liquid solvent thereby providing a method not only for preventing or reducing plugging of downstream process equipment but also for recovering valuable diamondoid compounds. Solvents useful in the solvation process of the invention include normally liquid hydrocarbons containing aromatics including petroleum-based solvents such as kerosene, diesel fuel, and heavy gasoline, with diesel fuel being the most preferred solvent.

Further, it has been found that a second separation step, silica gel sorption, is effective to sorb diamondoid compounds from a hydrocarbon gas stream. Depending upon the composition of the hydrocarbon gas stream, solvent addition may optionally be employed to reduce diamondoid deposition in the silica gel sorption equipment, with solvent injection to the silica gel regeneration circuit as described below being particularly beneficial.

In the most preferred embodiment of the invention for extracting diamondoid compounds from hydrocarbon gas streams, both the solvation and sorption steps are employed. The resulting diamondoid-enriched hydrocarbon liquid streams are then further resolved via thermal gradient diffusion. The diamondoid compound-containing hydrocarbon gas stream is first contacted with a suitable solvent as described above. The gas/liquid mixture is then separated, e.g. flashed, to form an at least partially purified gas stream and a liquid solvent stream enriched in diamondoid compounds. If the diamondoid compound-containing gas stream to be purified is rich in substituted higher boiling point adamantane homologues, the solvation and gas/liquid separation steps may produce a gas stream having acceptable purity. If, however, if the diamondoid compound-containing gas feedstream contains a substantial fraction of less substituted lower boiling point adamantane homologues, the silica gel sorption step may be necessary to achieve the desired gas product stream purity or extent of diamondoid recovery.

The present invention, then, provides a solvation process for extracting diamondoid compounds from a gas stream comprising the steps of providing a gas stream containing a recoverable concentration of diamondoid compounds, mixing the gas stream containing diamondoid compounds with a solvent in which diamondoid compounds are at least partially soluble, controlling the conditions including temperature and pressure of the mixture to maintain at least a portion of the mixture in the liquid phase, separating the mixture under these controlled conditions into a vapor stream and a diamondoid-enriched solvent stream, and recovering diamondoid compounds from the diamondoid-enriched solvent stream by passing said diamondoid-enriched solvent stream between two surfaces spaced apart up to about 0.01 inch at a temperature higher than the melting point of the lowest melting diamondoid in said diamondoid-enriched solvent stream up to about 500° F., and at a temperature differential between said surfaces of at least about 10° F. for a time sufficient to recover therefrom a first stream enriched in said diamondoid compounds, and a second stream depleated in said diamondoid compounds. The process may further comprise recycling the diamondoid-depleated solvent stream and mixing said diamondoid-depleated solvent stream with said diamondoid-containing hydrocarbon gas stream to at least partially saturate the diamondoid-depleated solvent.

The invention further provides a sorption process for extracting diamondoid compounds from a diamondoid-containing gas stream comprising the steps of providing a gas stream containing a recoverable concentration of diamondoid compounds, contacting the diamondoid-containing gas stream with silica gel in a sorption zone under conditions of temperature and pressure to prevent substantial formation of solid diamondoid desposits in the sorption zone for a period of time sufficient for the silica gel to sorb at least a poriton of the diamondoid compounds from the hydrocarbon gas, and regenerating the silica gel by contacting the silica gel with a regeneration fluid in which diamondoid compounds are at least partially soluble to desorb diamondoid compounds from the silica gel, and recovering diamondoid compounds from at least a portion of the regeneration fluid by passing at least a portion of the regeneration fluid between two surfaces spaced apart up to about 0.01 inch at a temperature higher than the melting point of the lowest melting diamondoid in the regeneration fluid up to about 500° F., and at a temperature differential between said surfaces of at least about 10° F. for a time sufficient to recover therefrom a first stream enriched in said diamondoid compounds, and a second stream depleated in said diamondoid compounds.

The preferred embodiment of the invention includes both the solvation and sorption stages, providing a process for extracting diamondoid compounds from a diamondoid-containing gas stream comprising the steps of providing a gas stream containing a recoverable concentration of diamondoid compounds, mixing the gas stream containing diamondoid compounds with a solvent in which diamondoid compounds are at least partially soluble, controlling the conditions including temperature and pressure of the mixture to maintain at least a portion of the mixture in the liquid phase, separating the mixture under the controlled conditions into a partially purified gas stream and a diamondoid-enriched solvent stream, recovering diamondoid compounds from the diamondoid-enriched solvent stream by passing said diamondoid-enriched solvent stream between two surfaces spaced apart up to about 0.01 inch at a temperature higher than the melting point of the lowest melting diamondoid in said diamondoid-enriched solvent stream up to about 500° F., and at a temperature differential between said surfaces of at least about 10° F. for a time sufficient to recover therefrom a first stream enriched in said diamondoid compounds, and a second stream depleated in said diamondoid compounds, contacting the partially purified gas stream with silica gel in a first sorption zone under conditions of temperature and pressure to prevent substantial formation of solid diamondoid desposits in the sorption zone for a period of time sufficient for the silica gel to sorb at least a poriton of the diamondoid compounds from the hydrocarbon gas, and recovering diamondoid compounds from silica gel by desorption in a second sorption zone by contacting the silica gel with a regeneration fluid in which diamondoid compounds are at least partially soluble to desorb diamondoid compounds from the silica gel, and recovering diamondoid compounds from at least a portion of the regeneration fluid by passing at least a portion of the regeneration fluid between two surfaces spaced apart up to about 0.01 inch at a temperature higher than the melting point of the lowest melting diamondoid in the regeneration fluid up to about 500° F., and at a temperature differential between said surfaces of at least about 10° F. for a time sufficient to recover therefrom a first stream enriched in said diamondoid compounds, and a second stream depleated in said diamondoid compounds.

DETAILED DESCRIPTION OF THE INVENTION

Figure 1:
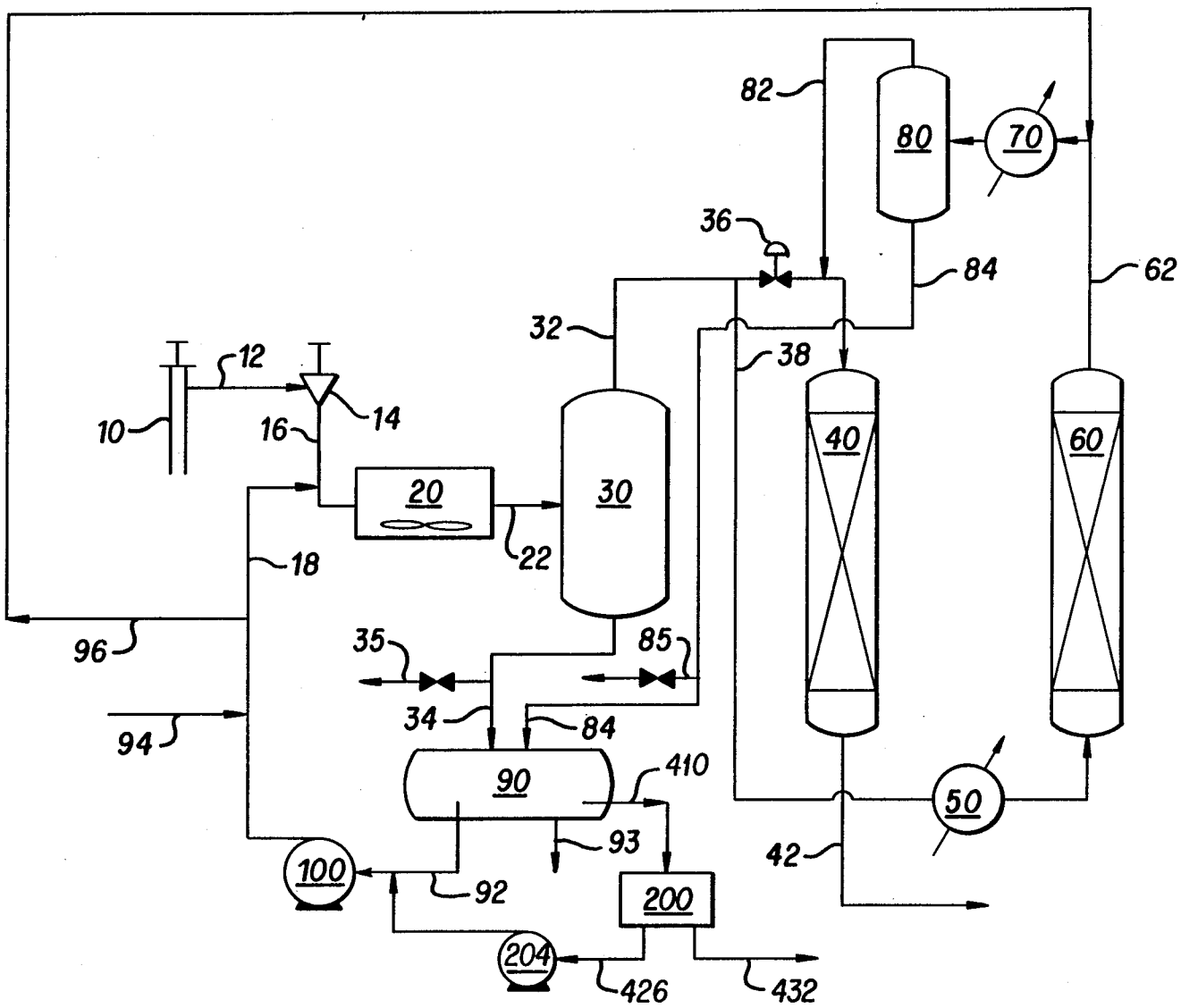
FIG. 1 is a simplified schematic showing major processing steps of a preferred embodiment of the present invention.

A thermal gradient diffusion process can operate in either a batch or continuous mode. The material to be resolved is placed between two (2) surfaces which differ in temperature. One factor effecting efficiency of resolution is the temperature of the two surfaces. Efficiency of separation is increased as a function of temperature, both the absolute temperature of both the surfaces, and the temperature of each surface relative to the other. It is preferred that the temperature of both surfaces be as high as practical, suitably about 50° to 500° F. It is most preferred that the temperatures of the surfaces be about 100° to 300° F.

With respect to the temperature differential between the two surfaces, this should be as great as practical, within the requirement that the temperature of both surfaces should be as high as practical. Suitably, the two surfaces should differ in temperature by at least about 10° F., preferably at least about 50° F. In accord with this invention then, the higher temperature surface is suitably maintained at a temperature of about 100° to 500° F., and the lower temperature surface is suitably maintained at a temperature of about 50° to 490° F., while maintaining the temperature differential as set forth above.

In accord with this invention, the two surfaces hereinbefore referred to, should preferably be spaced close together. It has been found that spacings of less than about 0.01 inch are appropriate. For better separation results, preferred spacing between the surfaces are up to about 0.003 inch. It is of course within the scope of this invention to provide multiple series or parallel surfaces and to utilize all the surface pairs, as well as the gaps therebetween, simultaneously or sequentially. Further, the surfaces of this invention may vary in length, both in the direction of flow of the hydrocarbon feed containing the diamondoid compounds, andnormal to the flow direction.

Differences in density of molecules closer to the hotter surface and molecules closer to the cooler surface cause convection currents to be set up within the apparatus between the surfaces. The most efficient separations are accomplished where the distance between the two surfaces is less than the radius of curvature of these convection currents. If this parameter is maintained, the molecules will strike a proximate surface before they have an opportunity to circulate around past that surface toward the other one. It is desired that the diamondoid molecules strike the cooler surface, and run down it to a collection point, without eddying back around. It is possible to assist in destroying eddy convection currents by installing baffles or insulation between the surfaces such that these eddy currents are disrupted, but not sufficient to severely retard the flow of molecules between the surfaces.

Since this separation process is dependent upon temperature differences and density differences between molecules, the separations can be assisted by artificially increasing gravitational forces acting on the molecules. This can be accomplished by carrying out the process under artificial gravity, such as by the application of centrifugal force. Artificial gravity up to about 100 G forces seems to be suitable.

The process of this invention can be carried out in several different modes to accomplish different objectives. If it is desired to remove as much diamondoid compound as possible from a hydrocarbon fraction without too much concern for the purity of the diamondoid fraction of the product, residence time in the instant process should be made relatively short, e.g. about 10 minutes. Further, if this is the object, low ratios of process direction length of the surfaces to width of the surfaces are desired, e.g. about 2 to 1. Still further, the highest achievable temperature and the highest achievable temperature differential should be used.

On the other hand, if it is desired to produce a lower rate of diamondoid recovery, but produce a purer diamondoid product stream, higher length to width ratios can be used. In this aspect of this invention, length to width ratios of as much as about 100 to 1 have been found to be suitable, with temperature differentials of about 10° to 50° F. being acceptable, and higher temperature differentials being desirable.

It is important in the practice of this invention that the overall temperature of the operation be such that the adamantane compounds do not precipitate from the feed stream. Thus, the operating temperatures may be limited by the melting point of the highest melting diamondoid compound in the feed. Adamantane is the highest melting diamondoid, 296° C. at atmospheric pressure, and so if the operating temperature is maintained above 296° C. with the pressure at atmospheric or higher, this condition will be fulfilled. However, because of mutual solubilities of diamondoids, crystallization is often inhibited and temperatures lower than the melting point of the highest melting point diamondoid present can be used. It is of course within this invention to operate at higher or lower pressures than atmospheric, depending upon other desirata, particularly good process operation. Therefore the absolute temperature requirement will vary depending upon the pressure. In any case, the functional requirement that the diamondoid be maintained as a liquid will govern.

Referring now to FIG. 1, a preferred embodiment of the present invention is schematically illustrated. A diamondoid-laden natural gas stream 12 is withdrawn from wellhead 10 at high pressure, generally 3000 to 15,000 psig, typically around 11,000 psig. Pressure reduction valve 14, commonly referred to as a choke, reduces the natural gas pressure downstream of the choke to between about 900 and about 1400 psig. Recycled solvent 18 is injected into the reduced pressure diamondoid-laden natural gas stream 16 upstream of process cooler 20 to prevent deposition of diamondoid solids within the cooler. Process cooler 20 is typically an air cooled exchanger with extended heat exchange tube surface area, commonly known as a fin-fan exchanger.

Solvent injection rates of about 2 to 6 gallons per minute (GPM) at natural gas flowrates of 10 to 15 million standard cubic feet per day (MMSCF/D) have been found to be effective to reduce diamondoid deposition. Thus to achieve the desired diamondoid sorption in the added solvent, solvent charge rates of about 100 to 1000 gallons per million standard cubic feet of natural gas (G/MMSCF) are acceptable, and rates of between about 200 and 800 G/MMSCF are preferred. The optimum charge rate within the disclosed ranges to minimize solvent costs while preventing diamondoid deposition in the downstream process equipment may be determined by one of ordinary skill in the art with a reasonable amount of trial and error.

If the solvent dosage selected for process operation is insufficient to maintain the diamondoids in solution through the process cooler, or if solvent injection is temporarily discontinued for operational reasons such as injection pump failure, diamondoids will likely be deposited on the inner surfaces of the process cooler heat exchange tubes, increasing the pressure drop across the air cooled exchanger. Thus one recommended method for determining optimum solvent dosage would be to monitor the change in natural gas pressure ($\Delta P$) across the process cooler with respect to time. An decrease in the $\Delta P$ across the process cooler would likely indicate diamondoid deposition on the inner surfaces of the cooler tubes and could be corrected with increased solvent dosage. The technique of the monitoring heat exchanger operation by evaluating $\Delta P$ over time is well known to those skilled in the art of heat exchanger design and maintenance.

Depending on the concentration of diamondoid compounds in the natural gas stream as well as on the operating temperature and pressure, discontinuation of the solvent charge may precipitate partial or complete plugging of at least a portion of the process cooler heat exchange tubes. Such deposits may be removed via intermittent high dosage or "slug" solvent treatment. Slug solvent treatment has been found to be effective for removing diamondoid deposits from process cooler heat exchange tubes, e.g., charging 50 to 100 gallon slugs of solvent intermittently into the 10 to 15 MMSCF/D natural gas stream at a point upstream of the process cooler. The slugged solvent is then recovered by a method similar to that used for the continuously injected solvent, which method is described below.

The cooled mixture of natural gas and solvent 22 flows to production separator 30 where it is flashed to form an overhead vapor stream 32 and a bottom liquid stream 34. Production separator 30 is illustrated as a flash drum, i.e. single stage vapor-liquid separation device, but may also comprise any suitable vapor-liquid separation apparatus known to those skilled in the art of process equipment design.

A first portion of the overhead vapor stream 32 flows through control valve 36 to enter sorption zone 40 while a second portion of the overhead vapor stream flow is preferably diverted by control valve 36 to form regeneration gas stream 38. The total overhead vapor stream may be charged to the sorption zone if an inert gas stream for use as a regeneration gas is both inexpensive and easily piped into the sorption process equipment. It is generally preferred, however, to use a portion of the overhead vapor stream as a regeneration gas due to its inherent economony and availability. Regeneration gas flow to the silica gel sorption zone is preferably countercurrent, i.e., gas flow for silica gel desorption during regeneration should be oriented in the opposite direction from gas flow for silica gel sorption during gas purification operation.

The first portion of the overhead vapor stream 32 then contacts a silica gel sorbent contained in sorption zone 40. The overhead vapor stream preferably flows downwardly in contact with the silica gel sorbent throught the length of the sorption zone 40. Silica gel volume is preferably selected such that almost all of the silicia gel sorption capacity is utilized before regeneration.

The purified gas stream 42 is then withdrawn from sorption zone 40 and charged to pipeline or storage facilities. The second portion of the overhead vapor stream is preferably diverted for use as a regeneration gas as described above. Part of the purified gas stream 42 may be compressed and heated for use as a regeneration gas (compression equipment not shown). Generating silica gel using the purified gas effluent, for example from sorption zone 40, may prolong the silica gel useful life by decreasing the rate of steam deactivation. Regeneration gas 38 is heated in regeneration heat exchanger 50 to a temperature less than 315° C. (600° F.), preferably between about 177° and 288° C. (350° and 550° F.) and then charged to the bottom of sorption zone 60 to countercurrently desorb water and heavy hydrocarbons, particularly diamondoids, from the silica gel. The length of the regeneration step is a function of regeneration gas temperature and flowrate as well as the amount of sorbed material contained in the silica gel sorption bed. These operating parameters may be varied to synchronize the regeneration cycle (desorption) of a first sorption zone with the gas purification cycle (sorption) of a second sorption zone. The sorption zones are preferably piped and valved in a parallel configuration such that one sorption zone may be operated in the gas purification mode while the other sorption zone is countercurrently regenerated.

Enriched regenerated gas 62 is colled to a temperature of between about 24° and 60° C. (75° and 140° F.) in regeneration cooler 70 and is flashed in regeneration separator 80 to form a overhead gas stream 82 and a liquid bottom stream 84. The overhead gas stream is preferably recycled and mixed with the production separator overhead stream and purified in sorption zone 40. The regeneration separator overhead gas stream 82 may optionally be mixed with purified gas stream 42. While such optional configuration beneficially reduces the total gas flow through the sorption zone operating in the gas purification mode, it necessarily reduces both diamondoid compound recovery and natural gas product purity.

Liquid bottom stream 34 from production separator 30 and 84 from regeneration separator 80 normally flow to solvent accumulator drum 90. A portion of the diamondoid-containing solvent 410 is drawn off the solvent accumulator and changed to thermal diffusion unit 200. Partially purified solvent 426 is then charged through pump 204 and mixed with diamondoid-containing solvent to be recycled. Thermal diffusion unit 200 is described below with reference to FIG. 2. Fresh solvent 94 is added downstream to maintain diamondoid concentration in the solvent below saturation. A water stream 93 is drawn off from solvent accumulator drum 90 and is sent to the process sewer for treatment and hydrocarbon recovery. The remaining diamondoid-containing solvent 92 is withdrawn from solvent accumulator drum 90, charged through pump 100 and mixed with fresh solvent 94 to form recycled solvent stream 18 which is added to the natural gas stream 16 upstream from process cooler 20 as described above.

A slip stream of diamondoid-containing solvent 96 may optionally be diverted from recycled solvent stream 18 and mixed with the enriched regeneration gas stream 62 upstream of regeration cooler 70. This slip steam addition to the enriched regeneration gas stream may be necessary to avoid diamondoid deposition in the regeneration gas cooler.

If the diamondoids contained in the feedstream to the present process consist predominately of adamantane and diamantane, it has been found that the two compounds may be effectively segregated and recovered separately. Given a feedstream in which the diamondoids principally consist of adamantane and diamantane, the liquid bottom streams from the production separator 30 and regeneration separator 80 have been found to be rich in diamantane and adamantane, respectively. Thus to recover the two compounds at relatively high purity, streams 35 and 85 are drawn off of streams 34 and 84, respectively, and are routed to separate diamondoid recovery processes (not shown).

Figure 2:
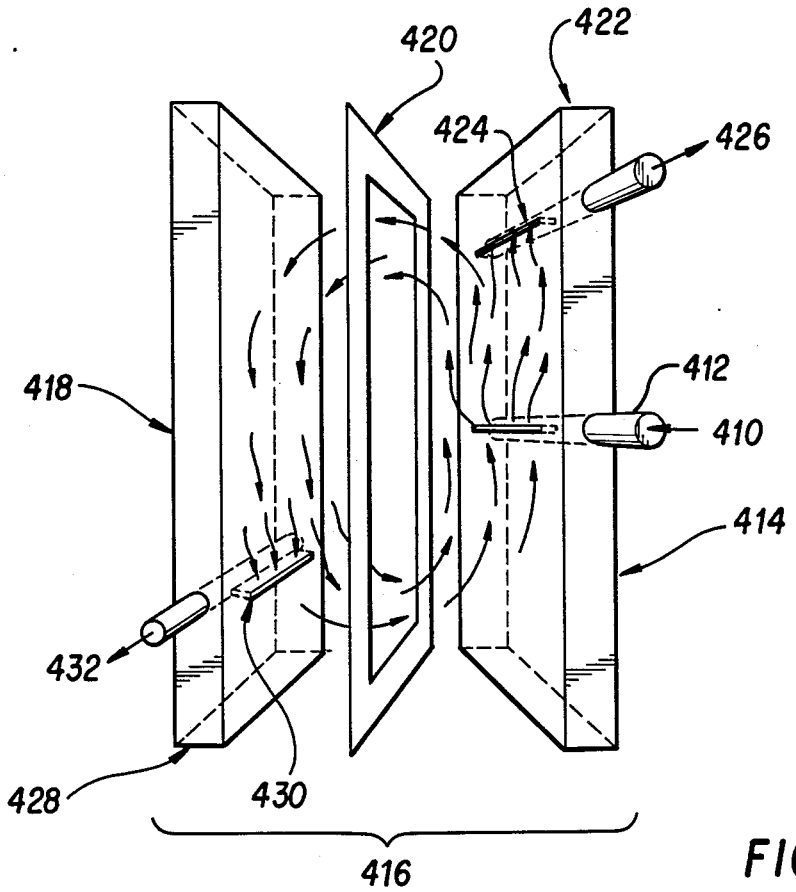
FIG. 2 is a schematic perspective view of an pparatus suited to use in carrying out this invention.

Referring now to FIG. 2, the aforementioned solution of diamondoid compounds 410 is fed to an intermediate height inlet 412 on the hotter side 414 of a thermal diffusion apparatus 416, as previously described herein. The hot surface 414 is maintained at a temperature of up to about 500° F. and is spaced apart from a parallel cooler surface 418 maintained at a temperature of less than about 490° F. The space between the surfaces is set to between 0.003 and 0.01 inch, which is maintained by a gasket 420 of that thickness interposed between the outer edges of the hot and cooler surfaces. Proximate to the top 422 of the hotter surface 414 is a channel 424 through which a stream of solvent 426, depleted in diamondoid compounds, is collected for recycle or other use. Proximate to the bottom 428 of the cooler surface 418 is a second channel 430 through which a concentrated stream of diamondoid compounds 432 is collected.

SPECIFIC EXAMPLES

In all of the examples, parts and percentages are by volume unless expressly stated to be on some other basis.

Figure 3:
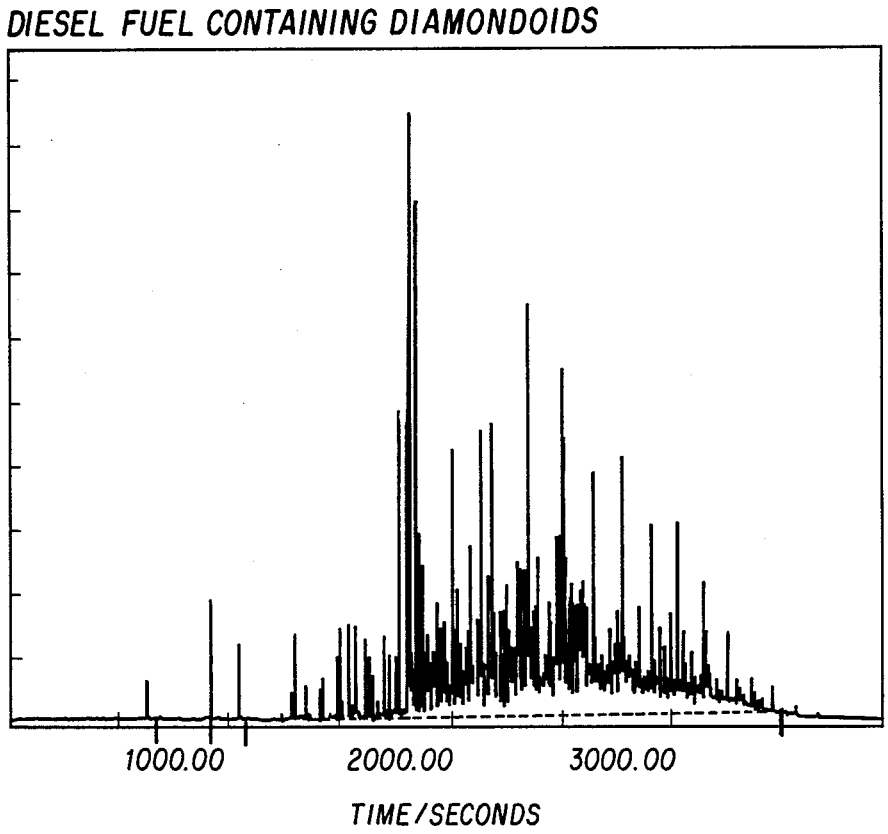
FIGS. 3, 4 and 5 show the results of chromatographic analyses.

In the following examples a mixture of an equilibrium mixture of 10 parts of diamondoids dissolved in 90 parts of an aromatic distillate fuel oil containing 0.8 wt. % of KW-111 brand carboxylic acid/polyamine antifoam and 400 ppm wt. of KP-151 brand thioalkyl substituted phenolic heterocyclic corrosion inhibitor was used. The antifoam and corrosion inhibitor were purchased from the Petrolite Company of St. Louis, Mo. The aromatic distillate fuel oil was a diesel fuel having an approximate composition as shown in the following Table. FIG. 3 shows a gas chromatographic analysis of the feed material.

| | |
|---|---|
| Aromatics | 46–58 wt. % |
| Paraffins | 22–29 wt. % |
| 1-ring Naphthenes | 12–18 wt. % |
| 2-ring Naphthenes | 5–6 wt. % |
| 3-ring Naphthenes | 1–3 wt. % |

EXAMPLE

The diamondoid containing feed mixture of diamondoids in aromatic distillate fuel described above was resolved into its components in a gas chromatograph which analyzed the product to contain 10 parts of diamondoid in 90 parts of hydrocarbon liquid. The chromatographic analysis of the feed mixture is shown in FIG. 3. The diamondoid containing product was then resolved in a thermal diffusion apparatus. The thermal diffusion apparatus included two concentric tubes approximately five (5) feet in length sized such that the outside diameter of the inner tube exceeded the inside diameter of the outer tube by approximately 0.006 inch. Thus the space between the two surfaces was approximately 0.003 inch. The inside diameter of the outer tube and the outside diameter of the inner tube were each approximately two (2) inches. The inner tube was maintained at a temperature of about 78° F. by flowing cooling water through the length of the inner tube. The outer tube was maintained at a temperature of about 148° F. by electric resistance heating.

Figure 4:
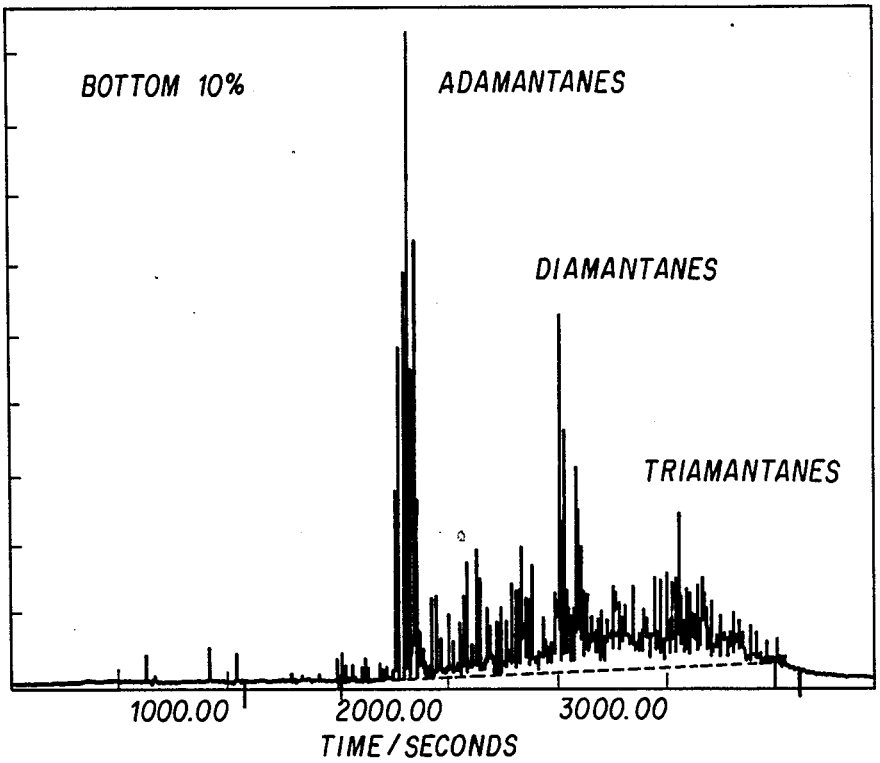
Figure 5:
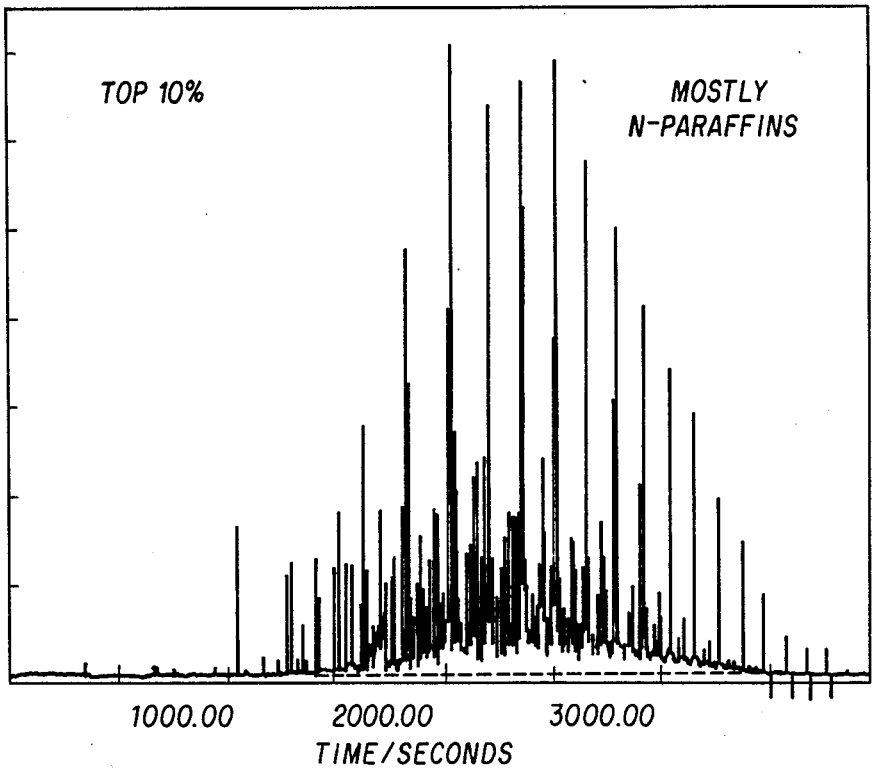

The diamondoid containing product mentioned above was then allowed to equilibrate in the thermal diffusion apparatus for a period of about 20 hours. The product was then sampled by withdrawing the top and bottom 10 volume percent from the thermal diffusion apparatus. The bottom 10% contained more than 20 weight percent diamondoid compounds as shown by chromatographic analysis in FIG. 4. The top 10% predominately contained normal paraffins as shown by chromatographic analysis in FIG. 5.

Changes and modifications in the specifically described embodiments can be carried out without departing from the scope of the invention which is intended to be limited only by the scope of the appended claims.

What is claimed is:

1. A process for removing diamondoid compounds from a hydrocarbonaceous fluid containing such, which comprises passing said fluid between two surfaces spaced apart up to about 0.01 inch at a temperature higher than the melting point of the lowest melting diamondoid in said fluid up to about 500° F., and at a temperature differential between said surfaces of at least about 10° F. for a time sufficient to recover therefrom a first stream enriched in said diamondoid compounds, and a second stream depleated in said diamondoid compounds.

2. A process as claimed in claim 1 wherein said surfaces are maintained at a temperature of about 50° F. to about 500° F.

3. A process as claimed in claim 1 wherein said surfaces are maintained at a temperature differential of about 100° F. to about 300° F.

4. A process as claimed in claim 1 wherein said fluid comprises distillate fuel oil.

5. A process as claimed in claim 1 including contacting natural gas containing a substantial concentration of diamondoid compounds with an aromatic distillate fuel oil for a time sufficient to extract diamondoid compounds from said natural gas and to form a solution of diamondoid compounds, and then passing said solution between said surfaces.

6. A process as claimed in claim 1 including sequentially passing said fluid between a multiplicity of said surface pairs in streamwise series, and recovering a diamondoid enriched product from each surface pair.

7. A process as claimed in claim 1 including substantially simultaneously passing said fluid between a multiplicity of said surface pairs, and recovering a diamondoid enriched product from each surface pair.

8. A process for extracting diamondoid compounds from a gas stream comprising the steps of:

(a) providing a gas stream containing a recoverable concentration of diamondoid compounds;

(b) mixing said gas stream containing diamondoid compounds with a solvent in which diamondoid compounds are at least partially soluble;

(c) controlling the conditions including temperature and pressure of said mixture of step (b) above to maintain at least a portion of said mixture in the liquid phase;

(d) separating said mixture under the controlled conditions of step (c), above into a vapor stream and a diamondoid-enriched solvent stream; and (e) recovering diamondoid compounds from said diamondoid-enriched solvent stream by passing said diamondoid-enriched solvent stream between two surfaces spaced apart up to about 0.01 inch at a temperature higher than the melting point of the lowest melting diamondoid in said diamondoid-enriched solvent stream up to about 500° F., and at a temperature differential between said surfaces of at least about 10° F. for a time sufficient to recover therefrom a first stream enriched in said diamondoid compounds, and a second stream depleated in said diamondoid compounds.

9. The process of claim 8 further comprising recycling said second diamondoid depleated stream of step (e) to at least partially saturate said diamondoid-depleated stream.

10. The process of claim 8 wherein said gas stream comprises natural gas.

11. The process of claim 10 wherein step (d) further comprises cooling said mixture of step (c).

12. The process of claim 10 wherein said cooling step comprises reducing the temperature of said mixture of step (c) to a temperature between about 24° and 60° C. (75° and 140° F.).

13. The process of claim 10 further comprising depressuring said natural gas stream to a pressure of not more than 21,000 kPa (3000 psig).

14. A process for extracting diamondoid compounds from a diamondoid-containing gas stream comprising the steps of:

(a) providing a gas stream containing a recoverable concentration of diamondoid compounds;

(b) contacting said diamondoid-containing gas stream with silica gel in a sorption zone for a period of time sufficient for said silica gel to sorb at least a poriton of said diamondoid compounds from said hydrocarbon gas;

(c) regenerating said silica gel by contacting said silica gel with a regeneration fluid in which diamondoid compounds are at least partially soluble to desorb diamondoid compounds from said silica gel; and (d) recovering diamondoid compounds from said diamondoid-enriched solvent stream by passing said diamondoid-enriched solvent stream between two surfaces spaced apart up to about 0.01 inch at a temperature higher than the melting point of the lowest melting diamondoid in said diamondoid-enriched solvent stream up to about 500° F., and at a temperature differential between said surfaces of at least about 10° F. for a time sufficient to recover therefrom a first stream enriched in said diamondoid compounds, and a second stream depleated in said diamondoid compounds.

15. The process of claim 14 wherein said silica gel contacting step (b) is carried out under conditions of temperature and pressure to prevent substantial formation of solid diamondoid desposits in said sorption zone.

16. A process for extracting diamondoid compounds from a diamondoid-containing gas stream comprising the steps of:

(a) providing a gas stream containing a recoverable concentration of diamondoid compounds;

(b) mixing said gas stream containing diamondoid compounds with a solvent in which diamondoid compounds are at least partially soluble;

(c) controlling the conditions including temperature and pressure of said mixture of step (b) above to maintain at least a portion of said mixture in the liquid phase;

(d) separating said mixture under the controlled conditions of step (c), above into a partially purified gas stream and a diamondoid-enriched solvent stream;

(e) recovering diamondoid compounds from said diamondoid-enriched solvent stream;

(f) contacting said partially purified gas stream with silica gel in a first sorption zone for a period of time sufficient for said silica gel to sorb at least a poriton of said diamondoid compounds from said hydrocarbon gas; and (g) recovering diamondoid compounds from silica gel in a second sorption zone by contacting said silica gel with a regeneration fluid in which diamondoid compounds are at least partially soluble to desorb diamondoid compounds from said silica gel.

17. The process of claim 16 wherein said silica gel contacting step (f) is carried out under conditions of temperature and pressure to prevent substantial formation of solid diamondoid desposits in said sorption zone.

18. The process of claim 1 further comprising extracting aromatics from said hydrocarbonaceous fluid.

19. The process of claim 8 further comprising extracting aromatics from said diamondoid-enriched solvent stream of step (d).

20. The process of claim 14 further comprising extracting aromatics from said diamondoid-enriched solvent stream of step (d).

* * * * *